US006409305B1

(12) United States Patent
Elgee et al.

(10) Patent No.: US 6,409,305 B1
(45) Date of Patent: Jun. 25, 2002

(54) FULL BLEED PRINTMODE TO MINIMIZE OVERSPRAY

(75) Inventors: Steven B Elgee; Dan Arquilevich, both of Portland, OR (US); Rick M Tanaka, Vancouver, WA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/781,131

(22) Filed: Feb. 9, 2001

(51) Int. Cl.[7] ..... B41J 23/00

(52) U.S. Cl. ..... 347/37

(58) Field of Search ..... 347/37, 12, 9

(56) References Cited

U.S. PATENT DOCUMENTS 5,997,129 A * 12/1999 Matsuhashi ..... 347/35
6,027,203 A * 2/2000 Campbell ..... 347/42
6,106,115 A 8/2000 Mueller et al. ..... 347/104

* cited by examiner

*Primary Examiner*—Thinh Nguyen

(57) ABSTRACT

Edge to edge printing techniques for reducing overspray beyond lateral edges of a print medium.

19 Claims, 6 Drawing Sheets

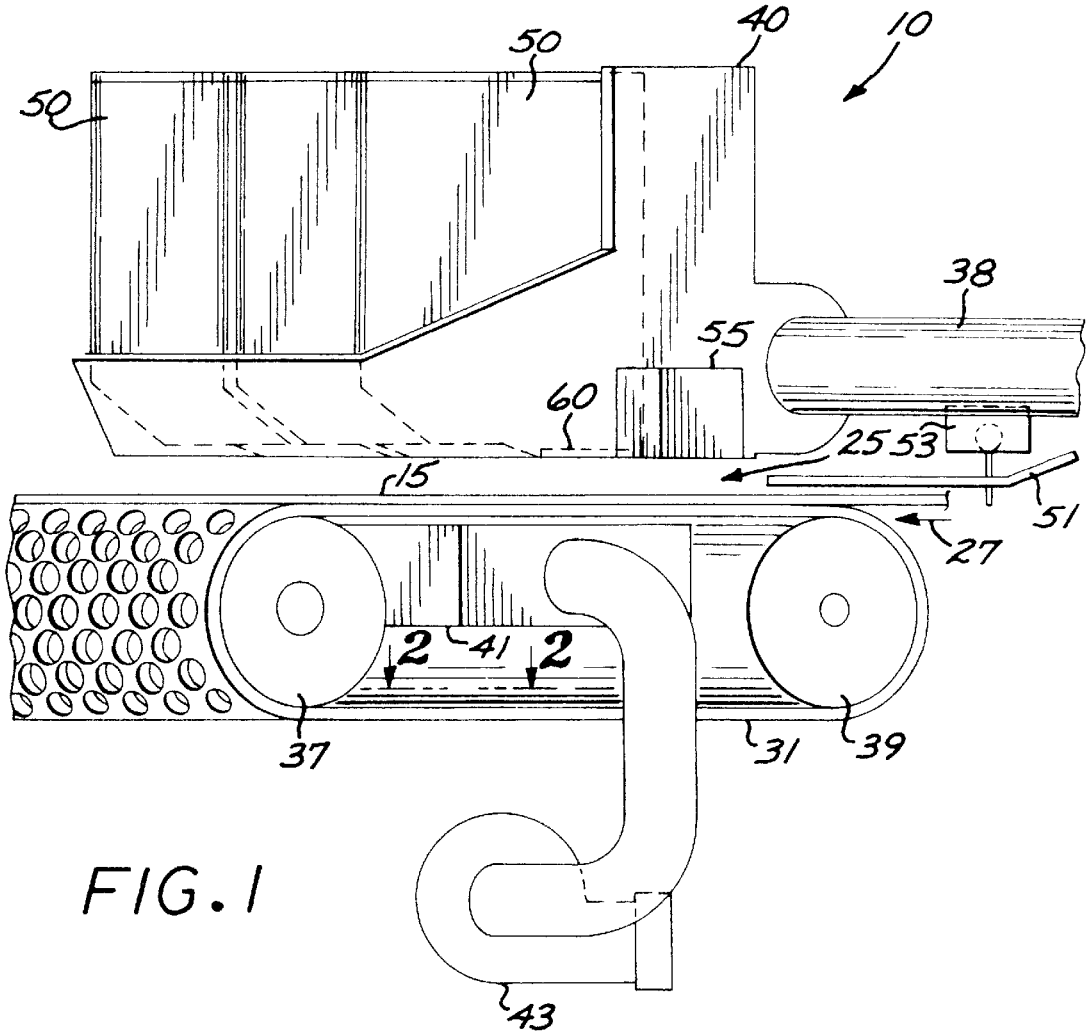
FIG. 1
FIG. 2
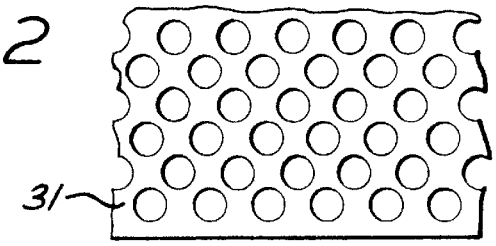

FIG. 10

PRINT DOTS LOCATED IN AT LEAST ONE DOT COLUMN ADJACENT A LATERAL EDGE ONLY WHEN CARRIAGE IS MOVING INBOUND OVER PRINT MEDIUM AT SUCH LATERAL EDGE

FIG. 11

DEPLETE DOTS IN AT LEAST ONE DOT COLUMN ADJACENT LATERAL EDGE

FIG. 12

DEPLETE DOTS OF A PREDETERMINED COLOR IN AT LEAST ONE COLUMN ADJACENT LATERAL EDGE

FIG. 13

DISABLE APPLICATION OF FIXED ADJACENT LATERAL EDGE

FULL BLEED PRINTMODE TO MINIMIZE OVERSPRAY

BACKGROUND OF THE INVENTION

The disclosed invention is generally directed to ink jet printing, and more particularly to techniques for accurately detecting the top edge and/or bottom edge of print media for full bleed printing.

An ink jet printer forms a printed image by printing a pattern of individual dots at particular locations of an array defined for the printing medium. The locations are conveniently visualized as being small dots in a rectilinear array. The locations are sometimes called "dot locations," "dot positions," or "pixels". Thus, the printing operation can be viewed as the filling of a pattern of dot locations with dots of ink.

Ink jet printers print dots by ejecting very small drops of ink onto the print medium, and typically include a movable carriage that supports one or more printheads each having ink ejecting nozzles. The carriage traverses over the surface of the print medium, and the nozzles are controlled to eject drops of ink at appropriate times pursuant to command of a microcomputer or other controller, wherein the timing of the application of the ink drops is intended to correspond to the pattern of pixels of the image being printed.

It has become desirable to provide "edge to edge" or "full bleed printing" wherein the printed image extends to the edges of the print media, for example for photographic images.

A consideration with full bleed printing is the need to avoid depositing excessive amounts of ink off the lateral or edges of the print media onto the media handling mechanism of the printer. Such off-media ink deposition causes unwanted marking of the back side of print media subsequently printed, which is deleterious to double sided printing. Also, the off-media deposition of ink could cause the media advance mechanism to malfunction.

SUMMARY OF THE INVENTION

The disclosed invention is directed to printing techniques that reduce overspray at the lateral edges of the print medium that are traversed by a print carriage as it reciprocatingly scans across the print medium.

BRIEF DESCRIPTION OF THE DRAWINGS

The advantages and features of the disclosed invention will readily be appreciated by persons skilled in the art from the following detailed description when read in conjunction with the drawing wherein:

FIG. 1 is a schematic depiction of an ink jet printing device in which the disclosed invention can be employed.

FIG. 2 is a plan view illustrating a portion of the media supporting endless belt of the ink jet printing system of FIG. 1.

FIG. 10 is a diagram of a further implementation of a printing procedure of the printing operation of FIG. 7.

FIG. 11 is a diagram of yet another implementation of a printing procedure of the printing operation of FIG. 7.

FIG. 12 is a diagram of another implementation of a printing procedure of the printing operation of FIG. 7.

FIG. 13 is a diagram of a further implementation of a printing procedure of the printing operation of FIG. 7.

DETAILED DESCRIPTION OF THE DISCLOSURE

Figure 3:
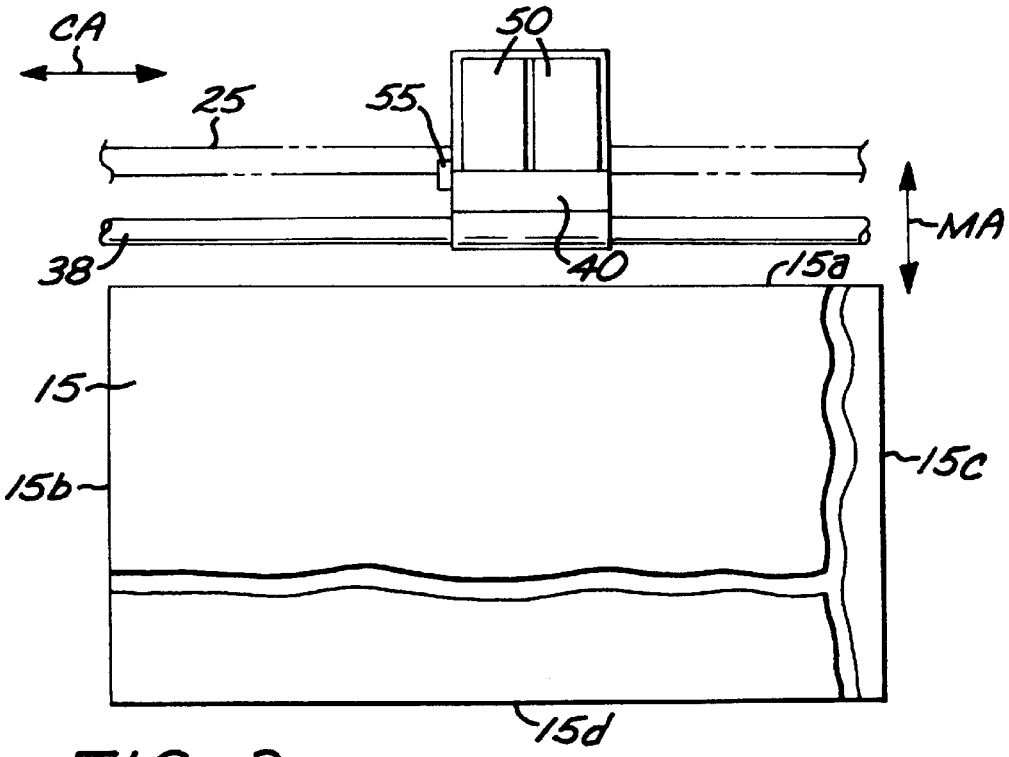
FIG. 3 is a schematic plan view illustrating the relative locations of media edge detecting components of the ink jet printing device of FIG. 1.

In the following detailed description and in the several figures of the drawing, like elements are identified with like reference numerals.

FIG. 1 is a schematic depiction of an examplary ink jet printing device 10 in which the disclosed invention can be employed. The ink jet printing device includes one or more ink jet print cartridges 50 that are supported by a print carriage 40 mounted on a slider rod 38 for reciprocating scanning movement along a carriage axis CA (FIG. 3). Each of the ink jet print cartridges 50 includes an ink jet printhead 60 having a plurality of ink drop generators for depositing ink jet dots on a portion of a print medium 15 (e.g., paper) that is located in a print zone 25 that underlies the area or region swept by the ink drop generators as the print carriage 40 is scanned. By way of illustrative example, each ink drop generator is a thermal ink jet drop generator comprised of a heater resistor, an ink chamber, and a nozzle.

Optionally, one of the print cartridges can be a fixer cartridge that applies fixer fluid onto the ink drops deposited on the print medium, for example to enhance dry time, smudge performance, light-fastness, and/or water-fastness.

The print medium 15 is more particularly supported and advanced along a media axis MA in a media advance direction 27 through the print zone 25 by an endless belt media transport subsystem that includes an endless perforated belt 31 (also shown in FIG. 2) mounted for rotation on belt pulleys 37, 39 that are driven to advance the print medium 15. The print medium 15 is picked from an input supply (not shown) and its leading edge 15*a* (FIG. 3) is delivered to a guide 51 that is configured to deliver the leading edge of the print medium 15 to the endless belt 31. An optional pinch roller may be used to assist transport of the print medium 15 through the print zone along a media axis MA. A vacuum plenum 41 that is coupled to a vacuum inducing pump 43 holds the print medium 15 tightly against the belt surface at the print zone. An output roller may be optionally used to receive the leading edge of the print medium 15 and continue the transport of the print medium until the trailing edge 15*d* (FIG. 3) of the print medium is released.

Figure 4:
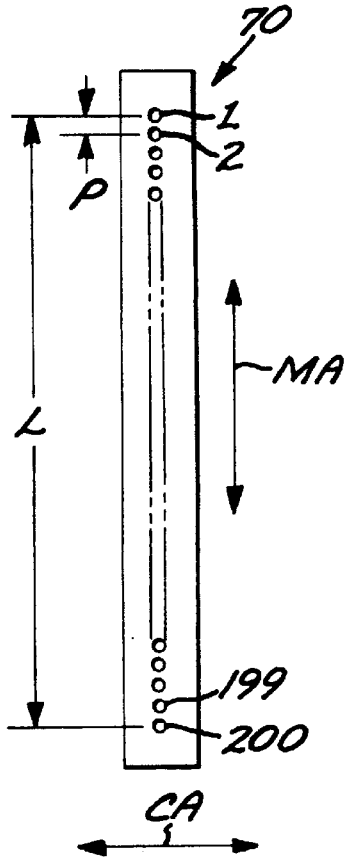
FIG. 4 is a schematic depiction of an ink jet nozzle array of the printer of FIG. 1.

As illustrated in FIG. 4, each of the printheads 60 of the print cartridges 50 of the printer of FIG. 1 includes an array 70 of ink jet nozzles having a center to center spacing or pitch P along the media axis MA, and a nozzle array height or length L along the media axis MA. For illustration purposes, the nozzle array 60 is shown as having 200 nozzles that are sequentially numbered in such a manner that nozzle 200 first encounters the print medium 15 as it is advanced along the media axis MA.

Figure 5:
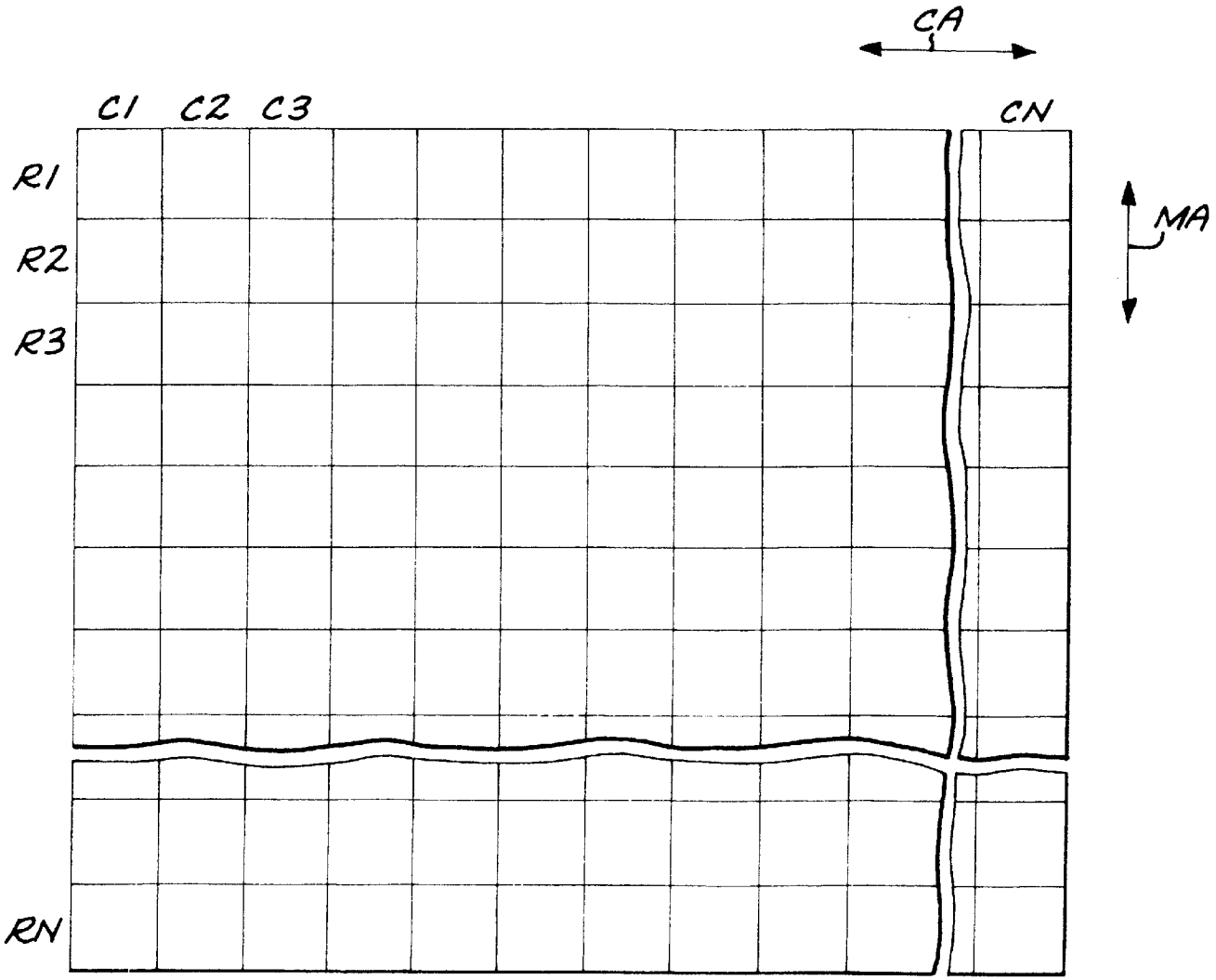
FIG. 5 schematically depicts a pixel array that would be printed by the ink jet printing device of FIG. 1.

Printing is accomplished by incrementally advancing the print medium 15 through the print zone 25, and controlling the ink jet nozzles to deposit ink drops while the carriage 40 is scanned between media advances. Referring more particularly to FIG. 5, the printer forms an image by scanning the print carriage 40 along the carriage axis and printing dots at selected pixel locations P of a two-dimensional pixel array defined for the image to be printed. The pixel locations or pixels P are conveniently arranged in rows Rl through RN and columns Cl through CN, wherein the rows are aligned with the carriage scan axis CA and the columns are aligned with the media axis MA. The number of pixels per unit distance along the carriage scan axis is referred to as the carriage axis resolution, while the number of pixels per unit distance along the media axis is referred to as the media axis resolution. The center to center distance between adjacent columns is the carriage axis dot pitch, while the center to center distance between adjacent rows is the media axis dot pitch.

It should be appreciated that an image is formed of a pattern of dots deposited on the pixel array, and the pixel locations that receive dots are sometimes referred to as pixels that are "on". Also, it is sometimes convenient to refer to the pixel rows of the image that is being printed, wherein each pixel row contains an appropriate pattern of pixels for that image.

As disclosed herein, techniques are provided for reducing overspray of ink off lateral edges 15*b*, 15*c* of the print medium 15. Such lateral edges 15*b*, 15*c* are traversed by the print carriage as it is scanned along the carriage axis. For reference, the print carriage is considered to be moving inbound at a lateral edge when the print carriage crosses over the lateral edge so as to be over the print medium. The print carriage is considered to be moving outbound at a lateral edge when the print carriage crosses over the lateral edge so as to be beyond the print medium. For convenience, the print carriage moves off the print medium when it is outbound, and moves onto the print medium when it is inbound.

Referring also to FIG. 3, the ink jet printing system further includes an optical edge detect sensor 55 mounted on the print carriage 40. The optical edge detect sensor 55 is used to detect the positions along the carriage axis of the lateral edges 15*b*, 15*c* of the print medium 15, and can be located at the print zone 25 or slightly upstream of the print zone 25. The optical edge detect sensor 55 more particularly is scanned along the carriage axis by scanning the print carriage 40 to detect the positions of the lateral edges of the print medium along the carriage axis, for example by noting carriage positions at which a transition in sensor output is noted.

Figure 6:
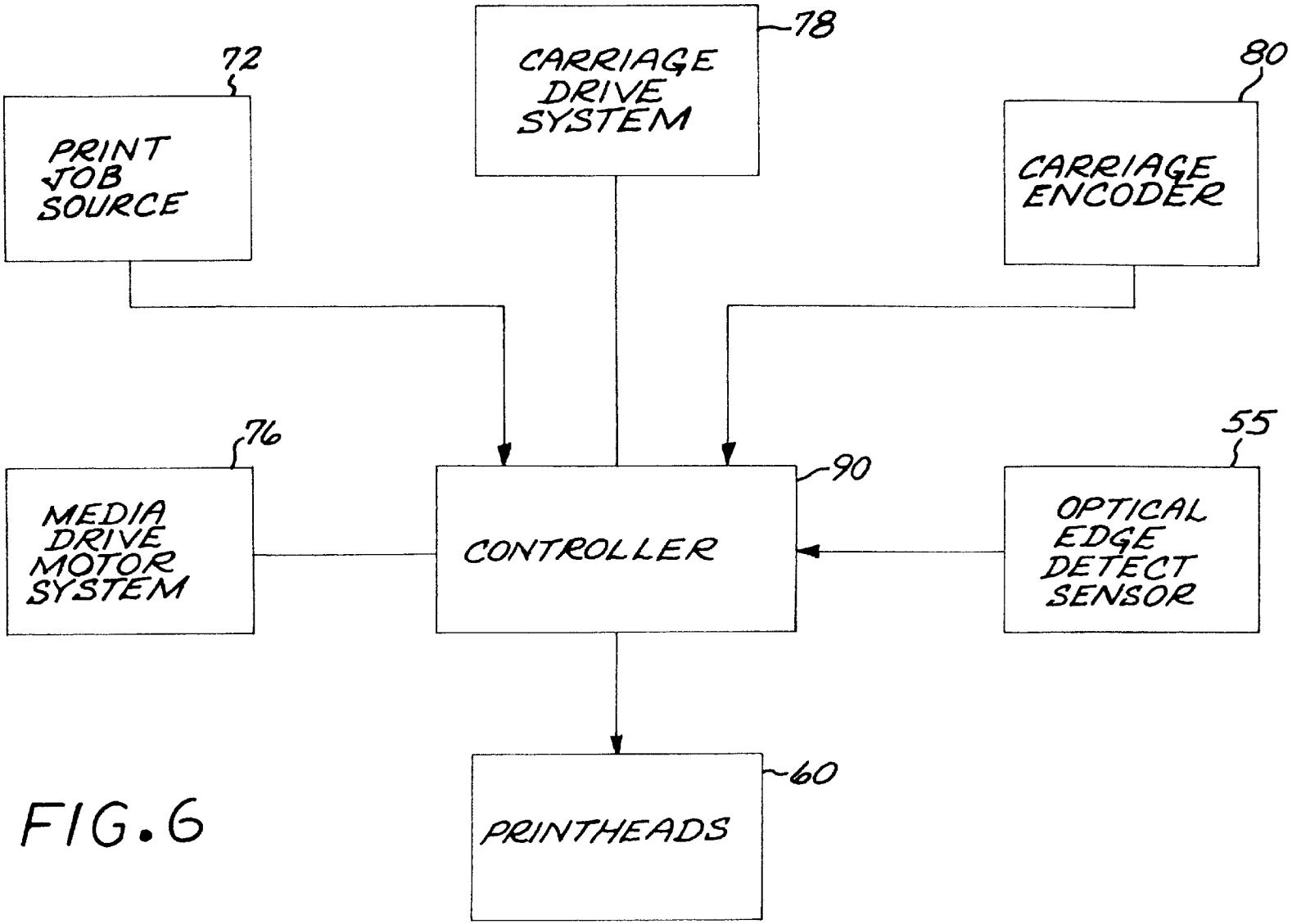
FIG. 6 is a block diagram of a control system for the printing device of FIG. 1.

FIG. 6 is a schematic block diagram of a control system for the printer of FIG. 1. A controller 90 such as a microcomputer receives print job commands and data from a print job source 72, which can be a personal computer, digital camera or other source of print jobs. The controller 90 acts on the received commands and data to activate a media drive motor system 76 to advance the print medium onto the belt, and move the belt to advance the sheet through the print zone 25. A carriage drive system 78 is controlled by the controller 90 to scan the carriage 40 along the slider rod 38. As the carriage 40 moves, firing signals are sent to printheads 60 of the print cartridges 50. The controller 90 receives encoder signals from a carriage position encoder 80 to provide position data for the print carriage 40. The controller 90 is programmed to incrementally advance the print medium 15 to position the print medium for successive scans of the print carriage 40 across the print medium 15.

The controller 90 further receives an output of the optical edge detect sensor 55, and performs printing operations based on such outputs as more particularly described herein.

Figure 7:
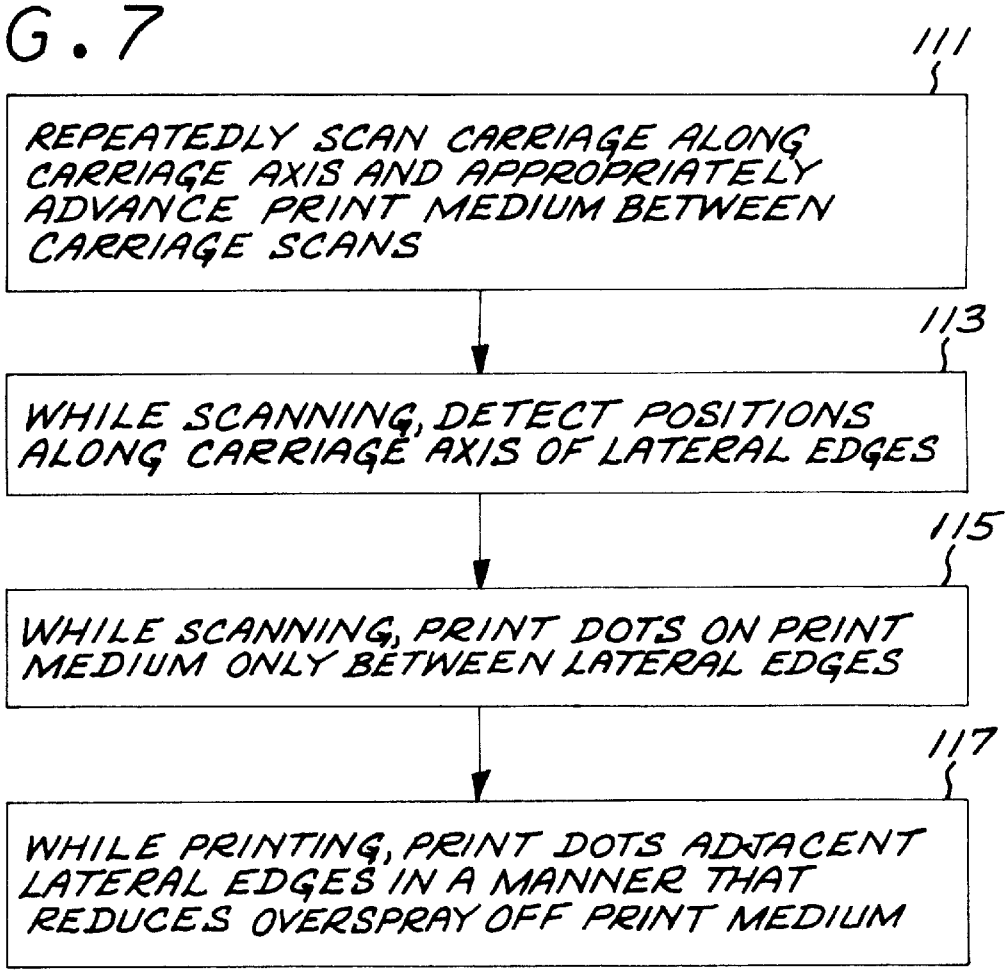
FIG. 7 is a flow diagram of an example of a printing operation that employs the invention.

Referring now to FIG. 7, set forth therein is an illustrative example of a procedure for printing that employs the invention. At 111 the print carriage is reciprocatingly scanned across the print medium and the print medium is appropriately advanced between carriage scans. At 113, while the print carriage is scanning, the positions of the lateral edges 15*b*, 15*c* of the print medium are detected, for example on every scan of the print carriage. At 115, while the print carriage is scanning, dots are printed on the print medium only between the lateral edges 15*b*, 15*c*. At 117, while printing, dots adjacent the lateral edges are printed in such a manner that reduces overspray off the print medium.

Figure 8:
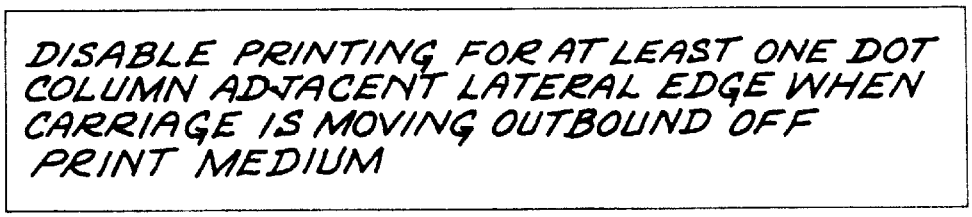
FIG. 8 is a diagram of a specific implementation of a printing procedure of the printing operation of FIG. 7.

Reduced overspray printing of dots adjacent the lateral edges can be more particularly accomplished by disabling printing of at least one dot column adjacent a lateral edge when the carriage is moving outbound off the print medium at such lateral edge (FIG. 8). By way of specific example, the printing of two dot columns adjacent a lateral edge is disabled when the carriage is moving outbound off the print medium at such lateral edge.

Figure 9:
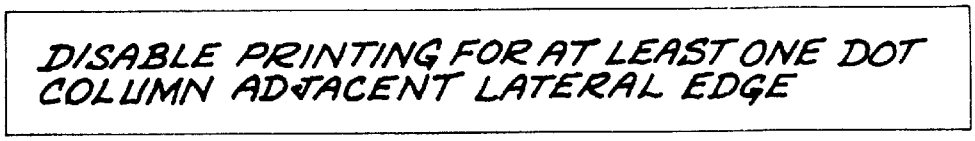
FIG. 9 is a diagram of another implementation of a printing procedure of the printing operation of FIG. 7.

Reduced overspray printing of dots can also be accomplished by disabling printing of at least one dot column adjacent a lateral edge (FIG. 9).

As another example, printing of dots adjacent the lateral edges can be accomplished by printing at least one dot column adjacent a lateral edge unidirectionally in the outbound direction wherein the print carriage is moving off the print medium at such lateral edge (FIG. 10).

As a further example, dots are depleted in at least one dot column adjacent a lateral edge, wherein some of the dots in the at least one dot column are not printed (FIG. 11). This is achieved for example by setting to the off state a predetermined pattern of print data bits for the at least one dot column.

As yet another example, dots of a predetermined color are depleted in at least one column adjacent a lateral edge (FIG. 12).

Also, in an implementation wherein one of the print cartridges comprises a fixer cartridge that deposits a fixer fluid, application of fixer is disabled adjacent the lateral edges (FIG. 13).

Thus, printing of dots adjacent the lateral edges in a manner that reduces overspray off the print medium can generally include printing at least one column of dots adjacent the lateral edges at a reduced print density as compared to the area inboard of the at least one column adjacent the lateral edges, disabling printing of at least one column of dots adjacent the lateral edges, and/or unidirectionally printing dots adjacent the lateral edges. Also, printing of dots adjacent the lateral edges in a manner reduces overspray can be implemented by printing at least one column of dots adjacent lateral edges only with dye-based ink, or by not applying fixer to at least one column of dots adjacent a lateral edge in an implementation that employs a fixer cartridge.

While the foregoing has been described in the context of a printer having a vacuum belt media advance system, it should be appreciated that the invention can be employed with other types of media advance systems including conventional pinch roller systems.

Although the foregoing has been a description and illustration of specific embodiments of the invention, various modifications and changes thereto can be made by persons skilled in the art without departing from the scope and the spirit of the invention as defined by the following claims.

What is claimed is:

1. A method of printing comprising:

reciprocatingly scanning a print carriage across a print medium having lateral edges that are traversed by the print carriage;

while scanning, ink jet printing dots on t he print medium; and while printing, printing dots adjacent the lateral edges in a manner that reduces overspray.

2. The method of claim 1 wherein printing dots adjacent the lateral edges in a manner that reduces overspray comprises printing at least one dot column adjacent a lateral edge only when the print carriage is moving in bound over a lateral edge.

3. The method of claim 1 wherein printing dots adjacent the lateral edges in a manner that reduces overspray comprises printing at least one column of dots adjacent a lateral edge at a reduced print density as compared to printing of dots inboard of said at least one column.

4. The method of claim 3 wherein printing at least one column of dots adjacent the lateral edge at a reduced print density comprises disabling printing of at least one column of dots adjacent a lateral edge when the print carriage is moving in an outbound direction over such lateral edge.

5. The method of claim 3 wherein printing at least one column of dots adjacent a lateral edge at a reduced print density comprises depleting at least one column of dots adjacent a lateral edge.

6. The method of claim 3 wherein printing at least one column of dots adjacent a lateral edge at a reduced print density comprises depleting at least one column of dots of a predetermined color adjacent a lateral edge.

7. The method of claim 1 wherein printing dots adjacent the lateral edges in a manner that reduces overspray comprises disabling printing of at least one dot column adjacent a lateral edge.

8. The method of claim 1 wherein printing dots includes applying fixer, and wherein printing dots adjacent the lateral edges in manner that reduces overspray includes disabling application of fixer to at least column of dots adjacent a lateral edge.

9. The method of claim 1 wherein printing dots adjacent the lateral edges in manner that reduces overspray includes printing at least one column of dots adjacent a lateral edge only with dye based ink.

10. The method of claim 1 further including detecting positions of the lateral edges while scanning the print carriage.

11. The printing apparatus of claim 1 wherein printing of at least one column of dots adjacent a lateral edge is disabled.

12. An ink jet printing apparatus comprising:

an array of ink jet printing elements;

a support structure for supporting said array of ink jet printing elements for reciprocating movement along a scan axis relative to a print medium such that said ink jet printing elements can print dots on a portion of the print medium that is in a print zone;

a media advance mechanism for advancing the print medium along a media advance axis through the print zone;

an edge sensor for sensing lateral edges of the print medium; and a controller responsive to said edge sensor for controlling the ink jet printing elements to print dots adjacent the lateral edges in such a manner as to reduce overspray.

13. The printing apparatus of claim 12 wherein at least one column of dots adjacent a lateral edge is printed only when the print carriage is moving inbound over a lateral edge.

14. The printing apparatus of claim 12 wherein at least one column of dots adjacent a lateral edge is printed at a reduced print density as compared to printing of dots inboard of said at least one column.

15. The printing apparatus of claim 12 wherein printing of at least one column of dots adjacent a lateral edge is disabled when the print carriage is moving in an outbound direction over such lateral edge.

16. The printing apparatus of claim 12 wherein at least one column of dots adjacent a lateral edge is depleted.

17. The printing apparatus of claim 12 wherein at least one column of dots of a predetermined color adjacent a lateral edge is depleted.

18. The printing apparatus of claim 12 further including an array of ink jet printing elements for applying fixer, and wherein fixer is not applied to printed dots adjacent the lateral edges.

19. The printing apparatus of claim 12 wherein at least one column of dots adjacent a lateral edge is printed only with dye based ink.

* * * * *